US006021927A

United States Patent [19]

Nomiyama et al.

[11] Patent Number: 6,021,927

[45] Date of Patent: Feb. 8, 2000

[54] DEGASSING DEVICE FOR AEROSOL CONTAINER AND LID PROVIDED WITH DEGASSING CONSTRUCTION

[75] Inventors: Koji Nomiyama; Yoshiaki Suwa, both of Tokyo, Japan

[73] Assignee: Osaka Ship Building Co., Ltd., Tokyo, Japan

[21] Appl. No.: 09/019,563

[22] Filed: Feb. 6, 1998

[51] Int. Cl.[7] ..... B65D 83/00; B67D 5/06

[52] U.S. Cl. ..... 222/402.14; 222/402.1; 222/182

[58] Field of Search ..... 222/182, 402.14, 222/402.13, 402.1

[56] References Cited

U.S. PATENT DOCUMENTS

| | | | |
|---|---|---|---|
| 3,765,573 | 10/1973 | Landsman | 222/182 |
| 4,195,756 | 4/1980 | Campbell | 222/182 |
| 4,260,080 | 4/1981 | Gailitis | 222/402.14 |
| 4,277,004 | 7/1981 | Barlics | 222/402.14 |
| 4,426,025 | 1/1984 | Knickerbocker | 222/182 |

FOREIGN PATENT DOCUMENTS

| | | |
|---|---|---|
| 6-69600 | 9/1994 | Japan . |
| 8324661 | 10/1996 | Japan . |
| 8-324661 | 12/1996 | Japan . |

*Primary Examiner*—Kevin P. Shaver
*Assistant Examiner*—Keats Quinalty
*Attorney, Agent, or Firm*—McDermott, Will & Emery

[57] ABSTRACT

A degassing device takes the form of lid or cap-like structure which is formed with notches/flexible members that engage the container being de-gassed and facilitate its application to various size containers. A through-hole into which a nozzle of the aerosol container is disposed, is provided with one or more shaped ribs which project out into the opening and engage the tip of the nozzle after it has passed a given distance through the through-hole. As the device continues to be pressed down into place on the container, the nozzle is depressed, the valve mechanism associated therewith is opened, and the remaining gas/fluid, which remains in the container is allowed to vent. A deflecting member is provided at the downstream end of the through-hole and arranged in the path of the venting gas/fluid to deflect fluid flow.

16 Claims, 13 Drawing Sheets

DEGASSING DEVICE FOR AEROSOL CONTAINER AND LID PROVIDED WITH DEGASSING CONSTRUCTION

BACKGROUND OF THE INVENTION

1. Field of the Invention

The present invention relates to a degassing device for an aerosol container adapted to carry out degassing from the aerosol container safely and easily and a lid provided with a degassing construction.

1. Description of the Prior Art

In the past, there has been employed, for removing gases from an aerosol container, a method of boring an exhaust hole in the body of the aerosol container using a borer or by an operator using a boring device such as a nail, a drill or the like. However, the method of boring an exhaust hole using a borer has a problem in terms of equipment cost and the installation site of the borer, and the method of forming an exhaust hole in the body of the container by an operator using a boring device has no problem in connection with the expenses as noted above but has a problem of requiring labor and time and involving a danger such as a rupture at the worst.

In view of the foregoing, recently, there has been disclosed a degassing device for an aerosol container and a degassing cap which can be mounted on the aerosol container simply and which can maintain an injection nozzle of the aerosol container in a depressed state merely by being mounted, (see Japanese Utility Model Application Laid-Open No. Hei 6-69600, and Japanese Patent Application Laid-Open No. Hei 8-324661).

SUMMARY OF THE INVENTION

However, the following problems have been involved in the above-described degassing device and the degassing cap. That is,since the shape and the size of a portion to be engaged of the aerosol container are different from maker to maker, it has been necessary to prepare degassing devices having separate shapes and sizes every aerosol containers of the makers. Further, when in degassing, there was a possibility that the exhaust gas is accidentally blown directly against a person or a machine.

In order to solve the problem as noted above, the present inventors have invented a degassing device in which an engaging through-hole is provided in an upper surface portion of the degassing device, a wall is provided externally surrounding the engaging through-hole, notches are formed in suitable locations of the wall to enable slight flexing deformation, and an engaging portion is formed on the wall.

According to the degassing device having the structure as described above, if the injection nozzle of the aerosol container is inserted into the engaging through-hole, and a peripheral edge of a nozzle forming opening of the aerosol container is engaged with the engaging portion formed in the wall, the injection nozzle is maintained in a pressed state (viz., a depressed open state). Therefore, residual gases can be discharged automatically and continuously. Further, since the notches are formed in the wall to enable flexing deformation, even if the shape and the size of the portion to be engaged of the aerosol container are somewhat different, a single degassing device will suffice.

Further, the present inventors had an idea of making use of a lid of the aerosol container. That is, this idea is that an engaging through-hole is provided in an upper surface portion of a lid which is normally placed positively, a wall is provided externally surrounding the engaging through-hole, notches are formed in suitable locations of the wall to enable slight flexing deformation, and an engaging portion is formed in the wall.

According to the lid having the structure as described above, the injection nozzle is inserted into the engaging through-hole turning upside down from the state in which the lid is placed over the aerosol container, and the peripheral edge of the nozzle forming opening of the aerosol container is engaged with the engaging portion, after which the lid is again placed over the aerosol container. Then, this can be used similarly to the above-described degassing device.

The present inventors further had an idea that in the construction of the above-described degassing device for the aerosol container and the lid of the aerosol container, a direction changing portion is formed at a part internally of the engaging through-hole to interrupt the axial direction of the engaging through-hole and to maintain an opening on the side. Since the exhausted gases can be dispersed and injected against the direction changing portion, the possibility that the exhausted gases are directly blown against the person or the machine can be removed.

DETAILED DESCRIPTION OF THE INVENTION

The present invention will be described hereinafter with reference to the drawings.

Figure 1:
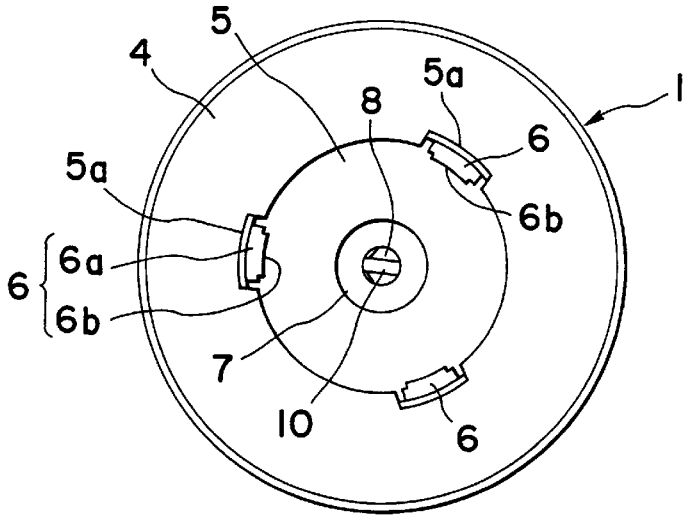
FIG. 1 is a plan view showing one example of a degassing device according to the present invention.
Figure 2:
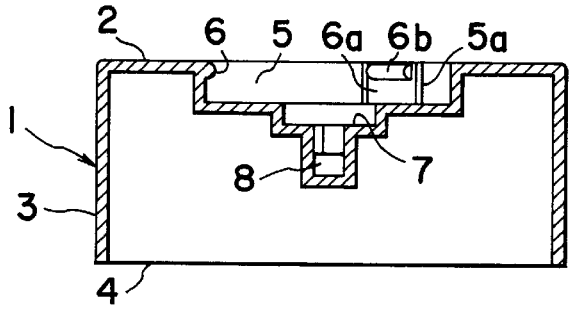
FIG. 2 is a longitudinal sectional view of the degassing device shown in FIG. 1.
Figure 3:
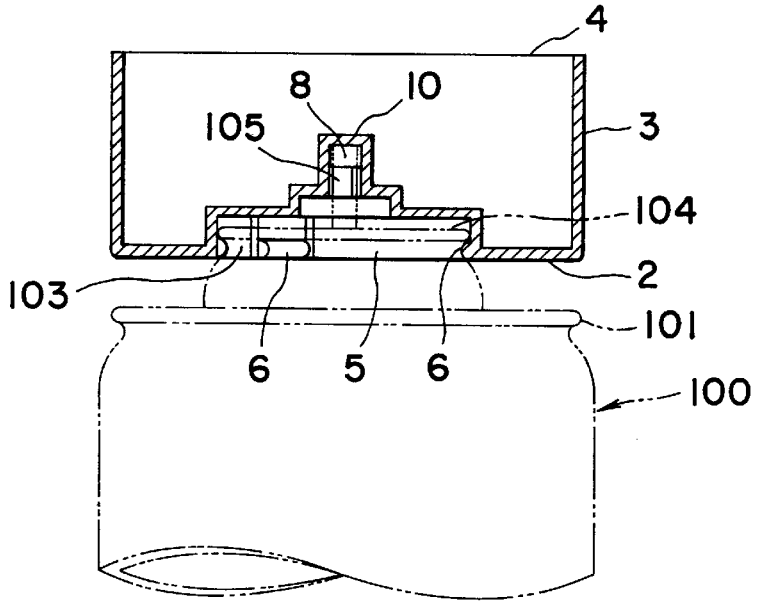
FIG. 3 is a longitudinal sectional view showing the degassing state in which the degassing device shown in FIG. 1 is fitted in a container.
Figure 4:
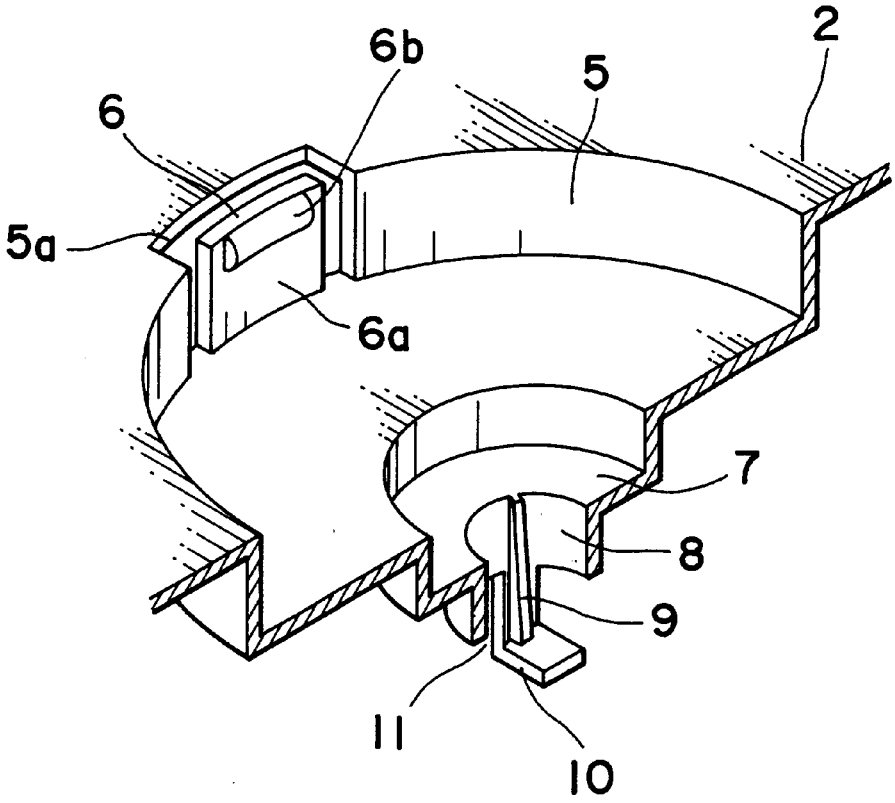
FIG. 4 is a perspective view of an outward portion showing that a depressed portion of the degassing device is cut in half.
Figure 5:
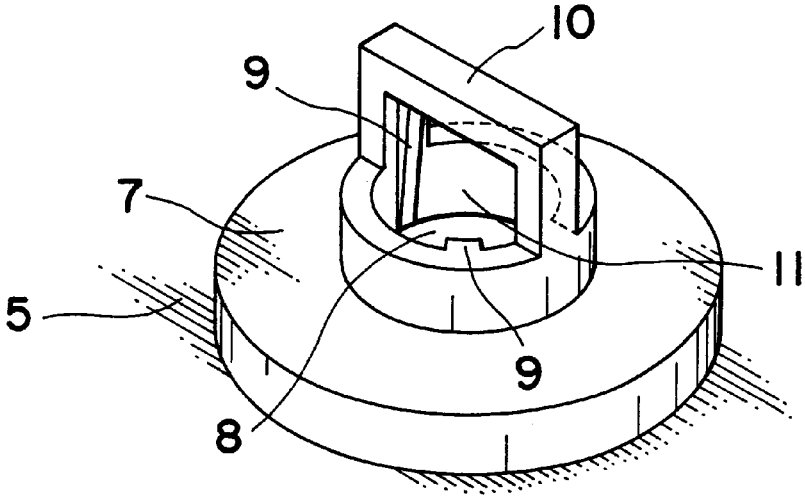
FIG. 5 is a perspective view of an inward portion showing an engaging through-hole portion of the degassing device.

FIG. 1 is a plan view of a degassing device 1 according to the present invention, and FIG. 2 is a longitudinal sectional view thereof. FIGS. 3, 4 and 5 show the degassing state in which the degassing device 1 is fitted in the container, the structure of a central portion in the upper surface portion of the degassing device 1, and the structure of an engaging through-hole (inside view), respectively.

An aerosol container 100 in the following drawings is one example of the aerosol container to be degassed, in which a caulked edge 101 is formed at the upper edge of the body of the container, an upper bulged portion 102 is provided at a central portion in the upper surface portion of the container, an upper peripheral edge of the bulged portion constitutes a caulked edge 103, an upper surface portion thereof is provided with a nozzle forming opening 104, and a rod-like nozzle 105 is projected in the central portion thereof. The nozzle 105 is formed integral with an exhaust opening and closing mechanism mounted internally of the nozzle forming opening 104, which may be of a well known suitable mechanism, that is, a mechanism in which a nozzle orifice is closed in the state in which the nozzle is elastically biased outward, and a nozzle orifice is opened in the state in which the nozzle is pressed inward (viz., depressed), and an extreme end thereof is projected externally.

The degassing device 1 comprises an upper surface portion 2 and a peripheral side portion 3, one end of the peripheral side portion 3 has a tubular shape forming an opening 4, and a depressed (viz., recessed) portion 5 depressed from outside toward inside is formed in the central portion of the upper surface portion 2.

The depressed portion 5 has the shape in which at least the nozzle forming opening 104 and the caulked edge 103 in the peripheral edge thereof out of the bulged portion 102 of the container, the depressed peripheral edge portion has an engaging portion 6 stopped at the caulked edge 103, the central portion constitutes a 2-stage uneven or stepped recess 7, and an engaging through-hole or opening 8 into which the nozzle 105 can be inserted is formed in the central portion.

In order that the engaging portion 6 may correspond to a slight difference of the size of the caulked edge 103 which occurs in the case where the container 100 is manufactured by different manufacturing machines including different makers, at least one notch 5*a* is formed in the peripheral surface portion of the depressed portion 5. A vertical projecting member 6*a* having a stop projection 6*b* internally of the upper end thereof, is formed within each notch 5*a* so as to leave a slight clearance, and so that the projecting member 6*a*, that is, the engaging portion 6 can be suitably elastically deformed in a horizontal direction (in an outward direction).

The uneven recess 7 is provided to facilitate the insertion of the nozzle 105 into the engaging through-hole 8.

The engaging through-hole 8 has an inside diameter and a suitable length (depth) to allow the insertion of the nozzle 105, the inner peripheral surface thereof is formed a plurality (three in the drawing) of stop ribs 9 extending in a direction coaxial with the hole, the stop rib 9 constituting an inclined projection projected into and toward the hole (toward the center axis) gradually closer to the end direction (internal direction) of the hole, the engaging through-hole 8 having the end (inside) constituting an opening, a bridge-like direction changing portion 10 is formed forwardly so as to interrupt the axial direction of the through-hole, and the direction changing portion 10 has both sides formed so as to constitute openings 11 as it is. The direction changing portion 10 can be formed, for example, on a portion provided by slightly extending in width the opposite portion of the peripheral wall of the engaging through-hole 8.

Figure 6:
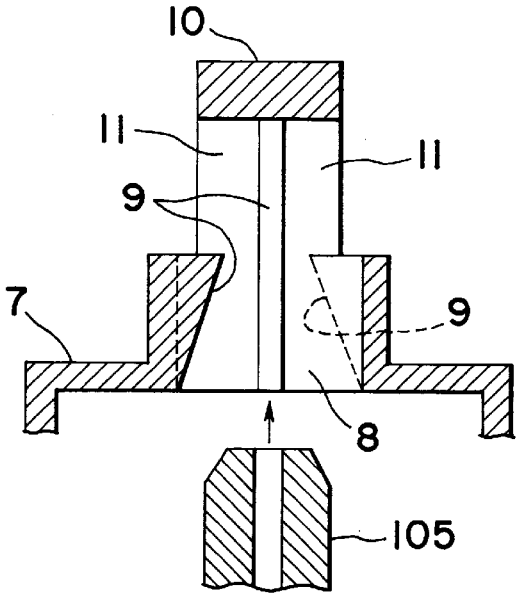
FIG. 6 is a fragmentary sectional view of the state before insertion of a nozzle showing the construction of the engaging through-hole portion.
Figure 7:
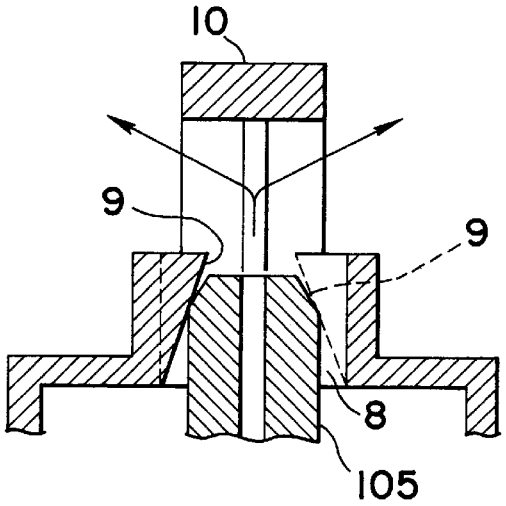
FIG. 7 is a fragmentary sectional view of the state after insertion of a nozzle showing the construction of the engaging through-hole portion.

In the degassing device 1 having the structure as described above, when degassing from the container 102 takes place as necessary, the depressed portion 5 (engaging portion 6) is fitted over the bulged portion 102 (caulked edge 103) of the container, as shown in FIG. 3. At this time, the nozzle 105 is inserted into the engaging through-hole 8, as shown in FIG. 6, but it impinges upon a middle portion of the inclined surface of the stop rib 9 which has a smaller diameter than the tip of the nozzle, as shown in FIG. 7, and therefore, the nozzle 105 is prevented from moving any further. The nozzle 105 is depressed due to this engagement and in the state in which the engaging portion 6 is stopped at the caulked edge 103 of the container, the nozzle is sufficiently pressed state as to assume its depressed normal state. The degassing device 1 is set so that the aforementioned pressed state is maintained unless the engagement is released.

The stop rib 9 is formed to have an inclined surface so that the former can positively stop and press the nozzle even if there is a slight difference in the outside diameter of the nozzle 105 caused by the difference of the container 100. If the degassing device 1 is formed of plastic materials such as polypropylene, polystyrene, polycarbonate, etc., the generality of the above-described function is further enlarged in addition to some deformability of the material itself.

Figure 8:
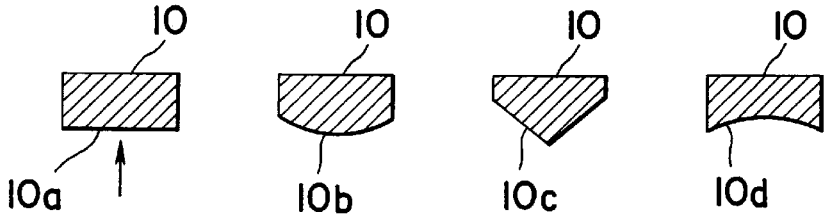
FIG. 8 is a longitudinal sectional view showing a modified form of a direction changing portion.

Further, in the direction changing portion 10, as shown in FIG. 8, a sectional state thereof may be a square, that is, a gas injection impinging surface may be a flat surface 9*a*, and other shapes, for example, the injection impinging surface may be a convex surface 9*b*, a triangular inclined surface 9*c*, a concave surface 9*d* and other suitable shapes to interrupt a straight movement.

Although not shown, the shape of the degassing device 1 and the mounting construction relative to the container 100 are not limited to those as described above.

Figure 9:
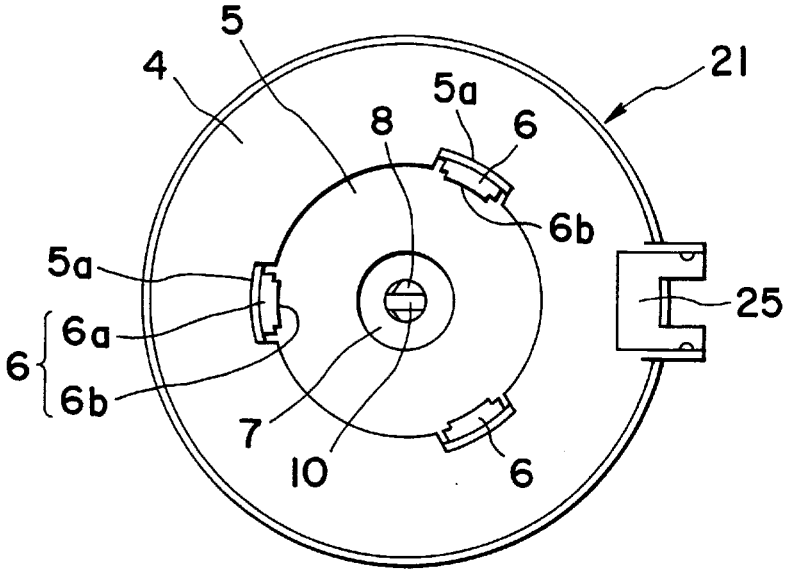
FIG. 9 is a plan view showing one example of a lid according to the present invention.
Figure 10:
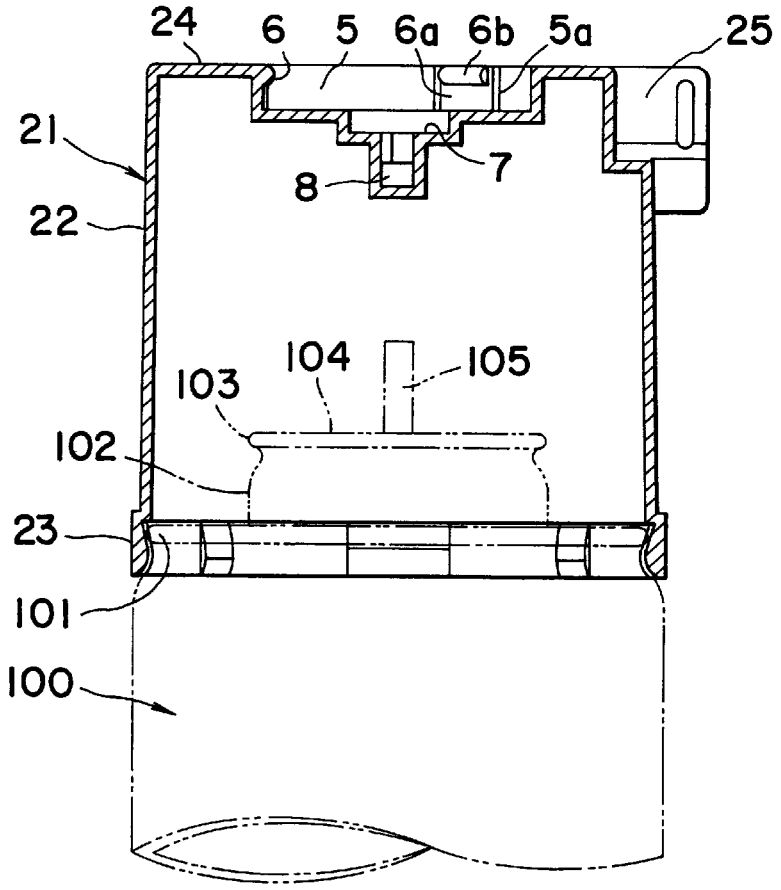
FIG. 10 is a longitudinal sectional view showing the state in which the lid shown in FIG. 9 is placed over the container.
Figure 11:
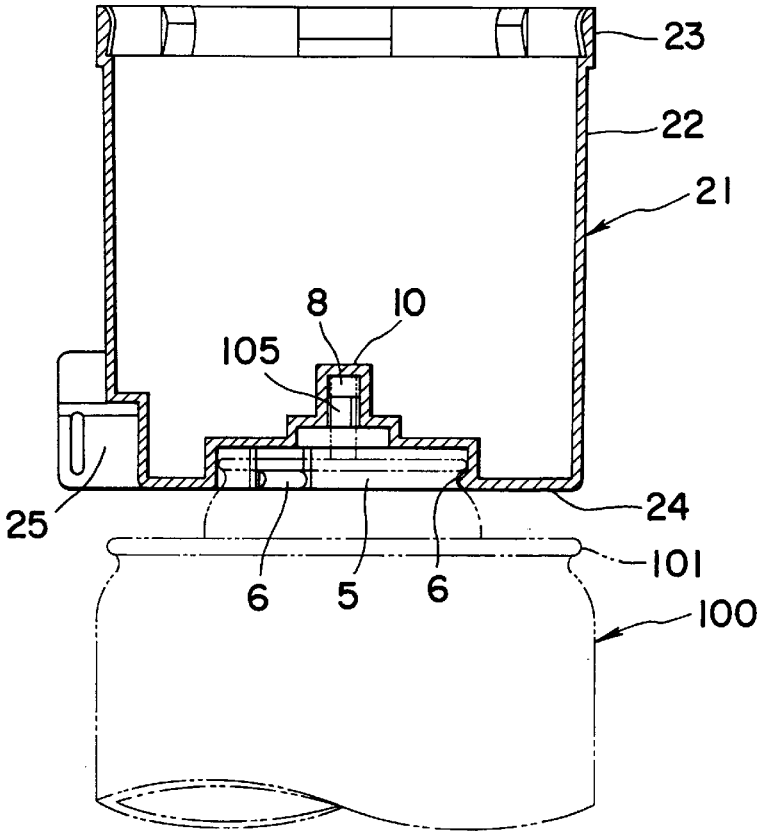
FIG. 11 is a longitudinal sectional view showing the degassing state in which the lid shown in FIG. 9 is reversely fitted over the container.

FIG. 9 is a plan view showing a lid 21 provided on the upper surface portion thereof with the degassing construction similar to that of the above-described degassing device 1. FIG. 10 shows the state in which the lid 21 is placed over the aerosol container 100 to be used as a normal lid, and FIG. 11 shows the state in which the lid 21 is used as the degassing device.

The lid 21 has a height enough not to press the nozzle 105 and has a tubular shape in which the lid is placed over the upper end of the container 100, wherein a fitting portion 23 having a projection capable of being stopped at the caulked edge 101 of the container is formed internally of the lower end of the peripheral side 22 thereof. A depressed portion 5 similar to that of the degassing device 1 is formed in the central portion of the upper surface portion 24, and the engaging portion 6, the uneven recess 7, the engaging through-hole 8, the stop rib 9 and the direction changing portion 10 are formed similarly to the above-described degassing device 1.

Normally, the lid 21 having the structure as described above is placed over the container 100 in the state in which the fitting portion 23 of the lid is fitted in the caulked edge 101 of the container for use, as shown in FIG. 10. However, when gases are removed from the container 100 as necessary, the depressed portion 5 (engaging portion 6) of the lid is placed over the bulged portion 102 (caulked edge 103) of the container, as shown in FIG. 11, and the lid 21 is placed over the container 100 in the reversed state for use. At this time, the nozzle 105 is inserted into the engaging through-hole 8, as shown in FIG. 5, but it impinges upon the middle portion of the inclined surface of the stop rib 9 formed so as to realize the state smaller in diameter than the tip of the nozzle, as shown in FIG. 6, and therefore, the nozzle 105 will not pass any further therethrough. The nozzle 105 is pressed in the impinged state, and in the state in which the engaging portion 6 of the lid is stopped at the caulked edge 103 of the container, the nozzle is in the sufficiently pressed state as the normal injection state. The lid 21 is set so that the aforementioned pressed state is maintained unless the engagement of the lid is released.

Numeral 25 denotes a support for stopping an auxiliary nozzle (not shown). The auxiliary nozzle is an elongated nozzle provided continuous to a connecting portion mounted on the tip of the nozzle 105. This is a well known nozzle used when injection is carried out in the direction different from the injecting direction of the nozzle 105.

When the lid 21 is used in the normal state, a small lid (not shown) can be mounted on the depressed portion 5 so as to block the latter.

Although not shown, the shape of the lid 21 and the fitting construction thereof over the container 100 are not limited to those as described above. Further, the fitting part in which the lid 21 is reversed and fitted over the upper portion of the container 100 and the fitting construction are neither limited to those as described above.

Figure 12:
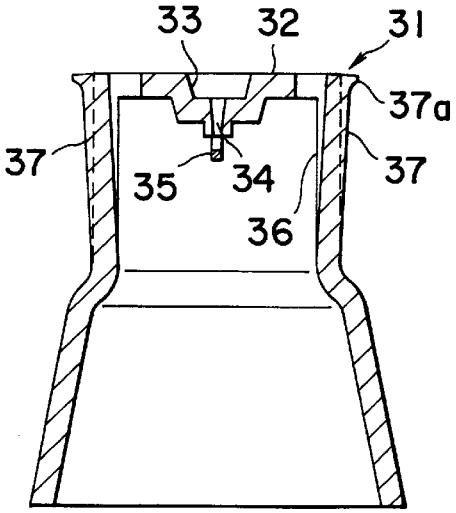
FIG. 12 is a longitudinal sectional view showing a modified form of the lid shown in FIG. 9.

The lids shown in FIG. 12 and thereafter are the lids according to the present invention, but show modified examples of the above-described embodiments.

In a lid 31 shown in FIG. 12, the outside diameter of an upper surface portion of the lid is formed to have the size capable of being fitted into a caulked edge 151 of the upper surface portion formed to be narrowed of an aerosol container 150, the depressed portion 5 and the engaging portion 6 of the lid 21 described above are not formed, and a recess 33 corresponding to the uneven recess 7 is formed in the central portion of the upper surface portion 32. An engaging through-hole 34 capable of inserting and pressing the nozzle is formed in the central portion similar to that described above, and a direction changing portion 35 similar to the above-described direction changing portion 10 is formed inwardly of the engaging through-hole. On the upper end of a peripheral side 36 externally of the upper surface portion of the lid, elastically deformable tongue-like stop pawls 37 which are erected along the peripheral side and somewhat projected outward gradually toward the end are formed at equal intervals at four locations of the peripheral side 22, and a stop projection 37*a* is formed externally of the end of the stop pawl 37.

Figure 13:
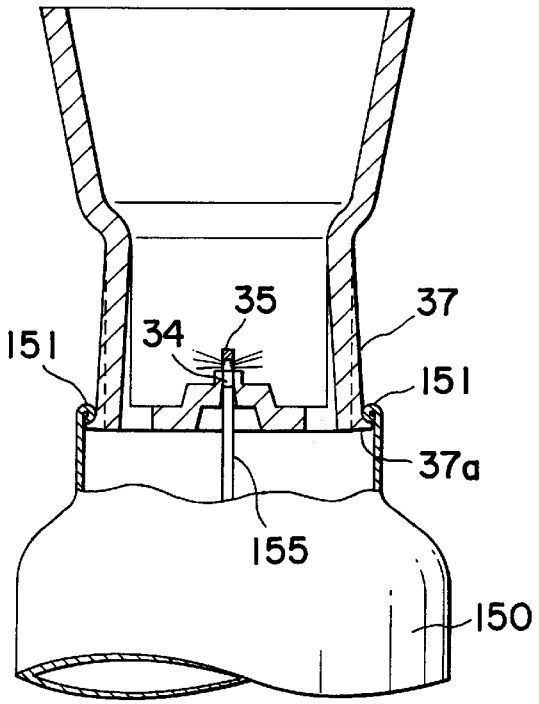
FIG. 13 is a longitudinal sectional view showing the state in which the lid shown in FIG. 12 is placed over the container.

The lid 31 is reversed as shown in FIG. 13, the upper end of the peripheral surface portion 36 is fitted into the caulked edge 151 of the upper peripheral edge of the aerosol container 150, and the stop pawls 37 are engaged. Then, simultaneously, the nozzle 135 of the container is inserted and pressed into the engaging through-hole 34 and placed in the injection state, and all the gases within the container can be exhausted.

Figure 14:
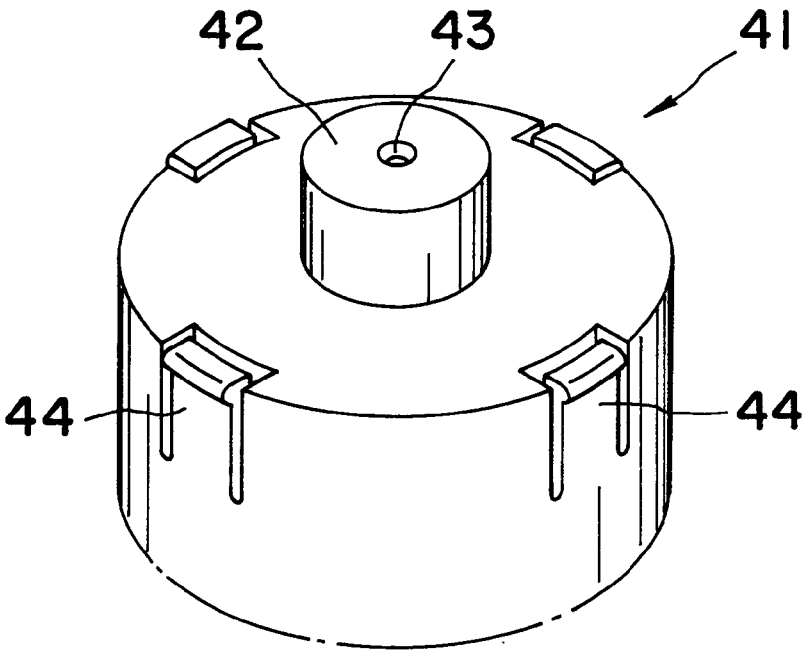
FIG. 14 is a perspective view of the upper portion of a lid according to a further modified form.
Figure 15:
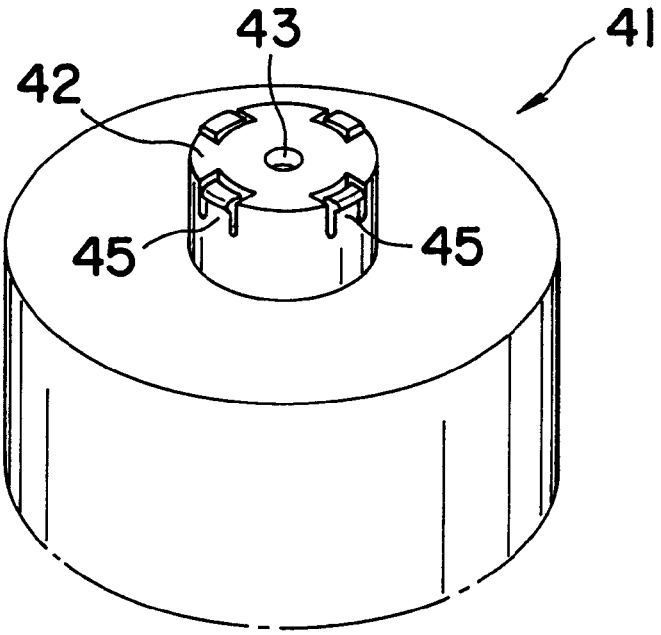
FIG. 15 is a perspective view of the upper portion of a lid different from the lid shown in FIG. 12.

In lids 41 shown in FIGS. 14 and 15, the depressed portion or the recess is not formed in the central portion of the upper surface portion of the lid, but a projection 42 is formed outward from the central portion of the upper surface portion, said projection being fitted into a nozzle orifice formed in the periphery of the nozzle of the aerosol container. An engaging through-hole 43 similar to that as described above is formed in the center of the projection 42, and a direction changing portion similar to that as described above is formed inward of the engaging through-hole. FIG. 14 shows an example in which a stop pawl 44 capable of engaging the aerosol container similar to FIG. 12 is formed on the upper end of the peripheral side of the lid. FIG. 15 shows an example in which a stop pawl 45 capable of engaging the inside of the peripheral edge of the nozzle orifice is formed on the upper end of the peripheral side of the projection 42.

Figure 16:
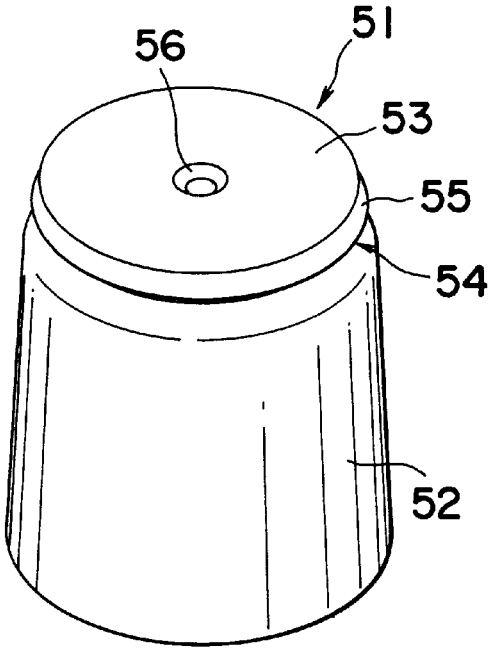
FIG. 16 is a longitudinal sectional view of a lid according to a further modified form.
Figure 17:
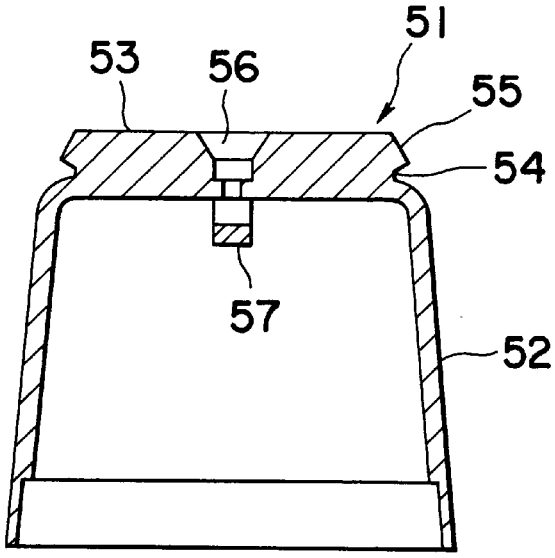
FIG. 17 is a longitudinal sectional view of the lid shown in FIG. 16.
Figure 18:
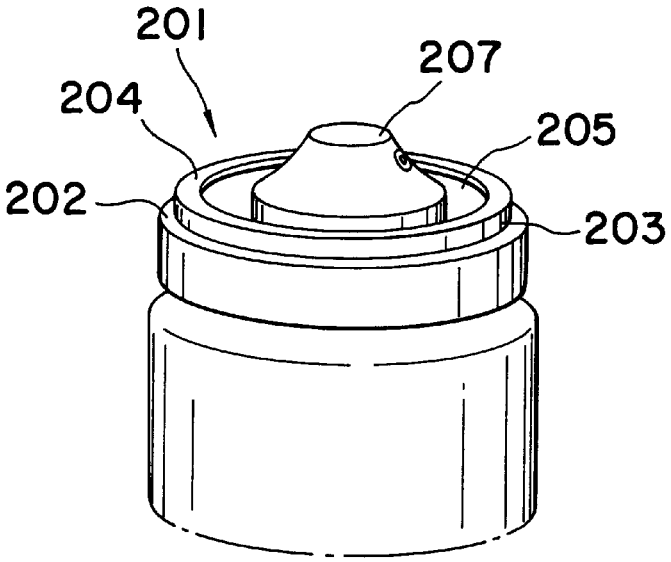
FIG. 18 is a perspective view of the upper portion of the container to be fitted with the lid shown in FIG. 16.

Lids 51 shown in FIGS. 16 and 17 have the lid structure in which the lid is placed over an aerosol container 201 as shown in FIG. 18. The container 201 has a cylindrical spout peripheral side 202 formed on the upper end with a difference-in-level cap mounting portion 203, and a spout upper edge 204, a depressed portion 205 having an upper surface portion thereof opened is formed internally of the upper edge, a nozzle 206 is projected in the center of the depressed portion, and a pressing and laterally injecting button 207 is mounted on the end of the nozzle.

On the other hand, the lid 51 of the present invention is formed to be cylindrical having a peripheral side 52 and an upper surface portion 53, an engaging groove 54 capable of engaging an inner peripheral end of the spout upper edge 204 is provided in the outer periphery in the vicinity of the upper end of the peripheral side 52, the upper end above the engaging groove constitutes a tapered engaging projecting edge 55 engaged in the state of being pressed into the inner peripheral end of the spout upper edge 204, the engaging projecting edge constitutes an outer peripheral edge of the upper surface portion 53, an engaging through-hole 56 similar to that as described above is formed in the center of the upper surface portion, and a direction changing portion 57 similar to that as described above is formed inwardly thereof.

Figure 19:
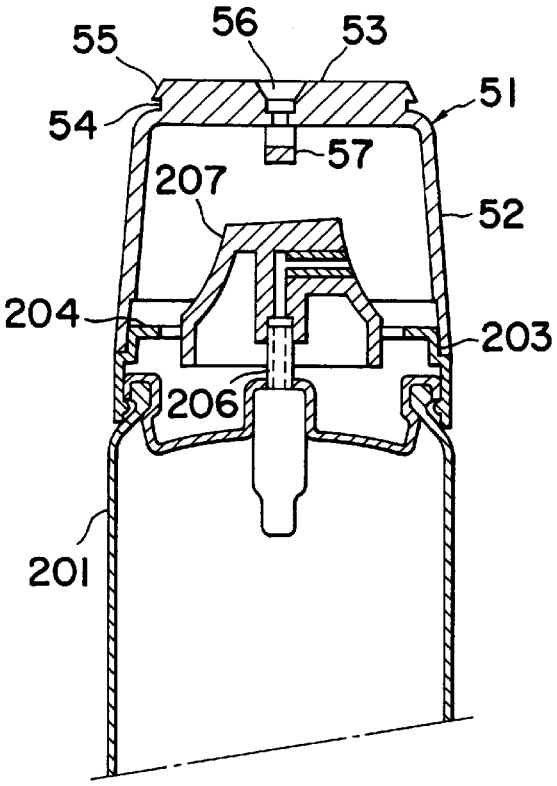
FIG. 19 is a longitudinal sectional view showing the state in which the lid shown in FIG. 16 is placed over the container.
Figure 20:
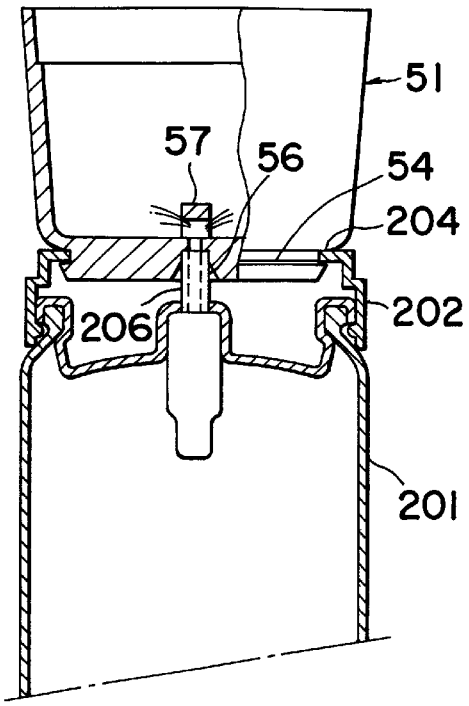
FIG. 20 is a longitudinal sectional view showing the degassing state in which the lid shown in FIG. 16 is reversely fitted over the container.

This lid 51 can be used as a normal lid with the lower end of the peripheral side of the lid 51 fitted over the cap mounting portion 203 of the aerosol container 201, as shown in FIG. 19. When degassing takes place, as shown in FIG. 20, the pressing and laterally injecting button 207 mounted on the end of the nozzle 206 is removed from the nozzle 206, the lid 51 is reversed so that the engaging projecting edge 55 and the engaging groove 54 are engaged with the inside of the spout upper edge 204, and the upper surface portion 53 of the lid is fitted in the aerosol container 201. Simultaneously, the nozzle 206 of the container is inserted and pressed into the engaging through-hole 56 and placed in the injecting state so that all the gases can be exhausted.

Figure 21:
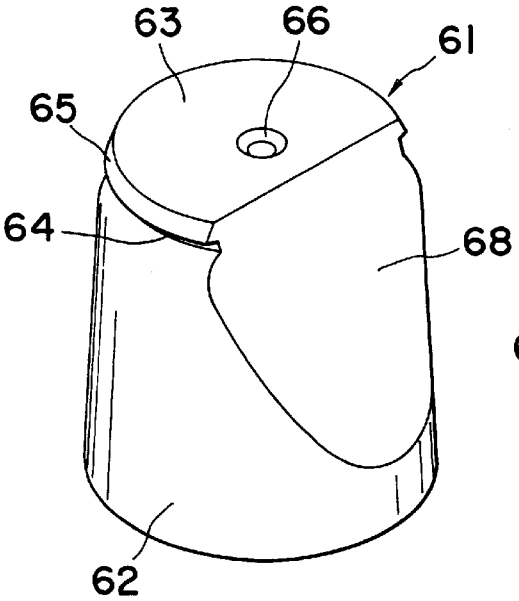
FIG. 21 is a perspective view of a lid according to another modified form.
Figure 22:
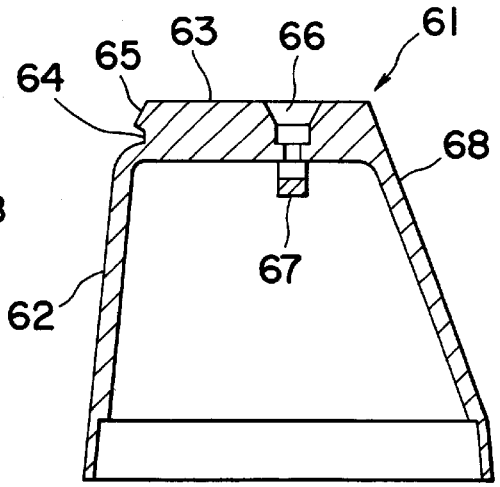
FIG. 22 is a longitudinal sectional view of the lid shown in FIG. 21.
Figure 23:
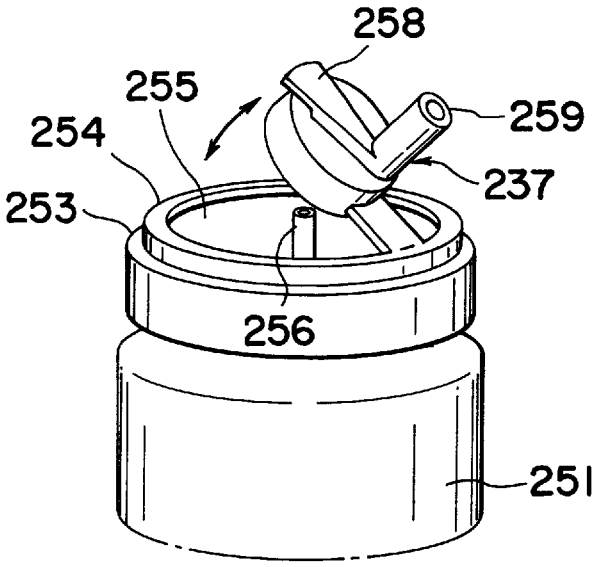
FIG. 23 is a perspective view of the upper portion of the container to be fitted with the lid shown in FIG. 21.

Lids 61 shown in FIGS. 21 and 22 have the lid structure in which the lid is placed over an aerosol container 251 as shown in FIG. 23. The container 251 has a circumferential spout upper edge 254 formed on the upper end with a difference-in-level cap mounting portion 253 similar to that of FIG. 18, and a depressed portion 255 having an upper surface portion opened is formed internally of the upper edge. A nozzle 256 is projected around the depressed portion, and an actuator 257 which is vertically bendable and mounted on the end of the nozzle is provided on a part of the spout upper edge 254. The actuator is formed with an injecting opening 259 connected to a pressing portion 258 and the nozzle.

The lid 61 is cylindrical and is composed of a peripheral side 62, an upper surface portion 63, an engaging groove 64, an engaging and projecting edge 65, an engaging through-hole 66, and a direction changing portion 67, being formed with an inclined wall 68 having an upper portion on one side of the lid cut in an inclined manner gradually from the lower portion on one side of the peripheral side 62 toward the neighborhood of the center of the upper surface portion 63.

Figure 24:
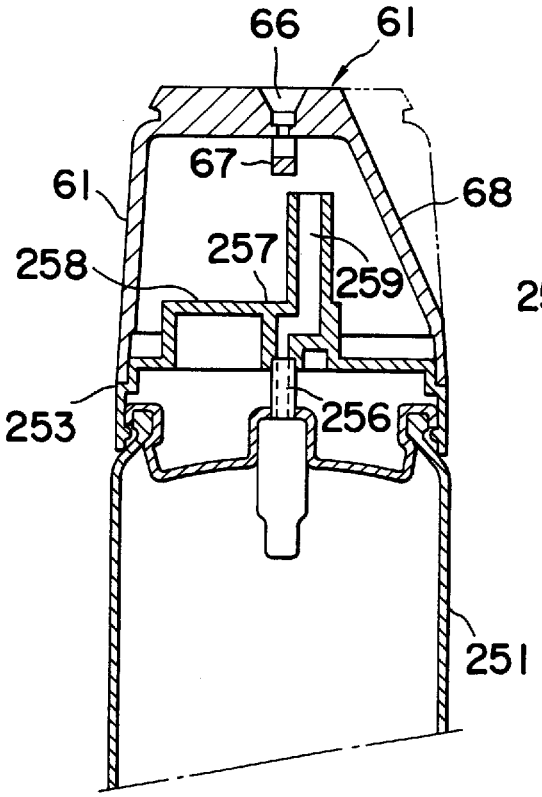
FIG. 24 is a longitudinal sectional view showing the state in which the lid shown in FIG. 21 is placed over the container.
Figure 25:
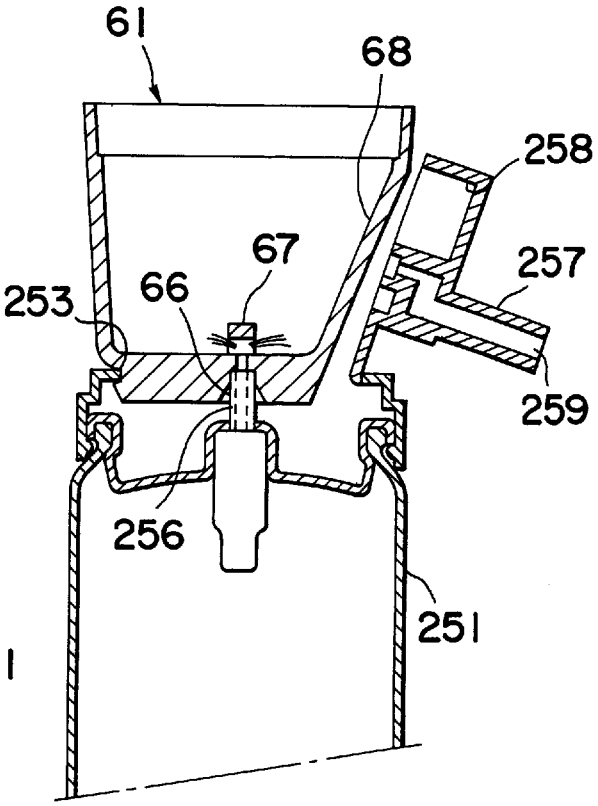
FIG. 25 is a longitudinal sectional view showing the degassing state in which the lid shown in FIG. 21 is reversely fitted over the container.

The lid 61 can be used as a normal lid with the lower end of the peripheral side of the lid 61 fitted in the cap mounting portion 253 of the aerosol container 251, as shown in FIG. 24. When degassing takes place, as shown in FIG. 25, the actuator 257 mounted on the end of the nozzle 256 is removed from the nozzle 256 and bent outward, in which state, the lid 61 is reversed so that the projecting edge 65 and the engaging groove 64 are engaged with the inside of the spout upper edge 254, and the upper surface portion 63 of the lid is fitted in the aerosol container 251. The actuator 257 touches the outside of the inclined wall 68 of the lid and is not in the way in the bent state, and at the same time, the nozzle 256 of the container is inserted and pressed into the engaging through-hole 66 and placed in the injectingstate so that all the gases can be exhausted.

The inclined wall 68 of the lid may be provided with an anti-skid means, for example, such as the provision of a rubber sheet.It is noted that the structure of the lid and the aerosol container may be modified to those other than the above.

Next, a degassing device 71 different in degassing construction from the above-described degassing device 1 and a lid 81 will be described below.

Figure 26:
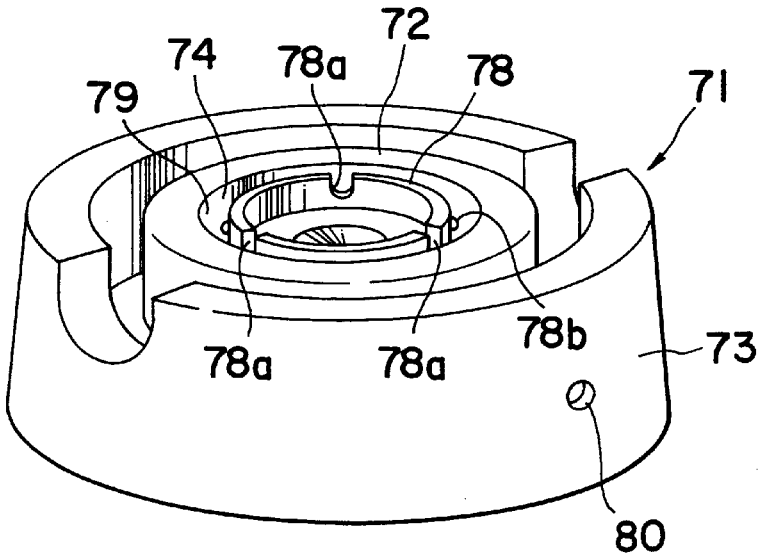
FIG. 26 is a perspective view showing one example of a degassing device according to an embodiment different from that of the degassing device shown in FIG. 1.
Figure 27:
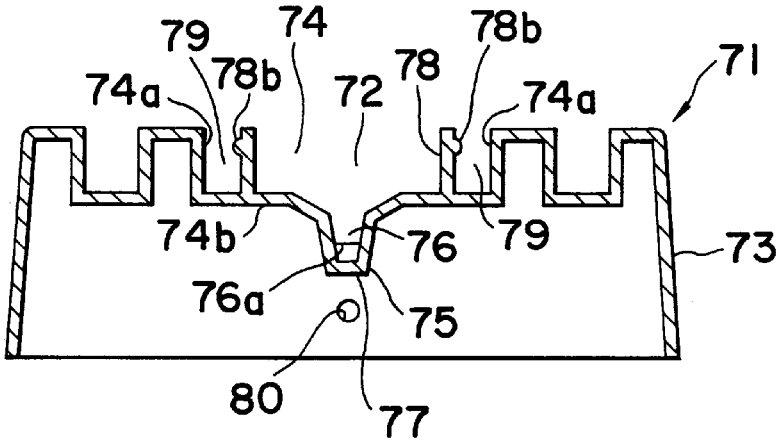
FIG. 27 is a longitudinal sectional view of the degassing device shown in FIG. 26.
Figure 28:
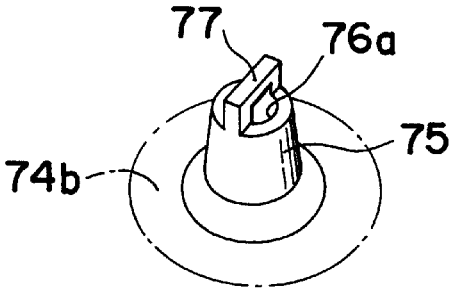
FIG. 28 is a perspective view of the inward structure of an exhaust side of the engaging through-hole of the degassing device shown in FIG. 26.
Figure 29:
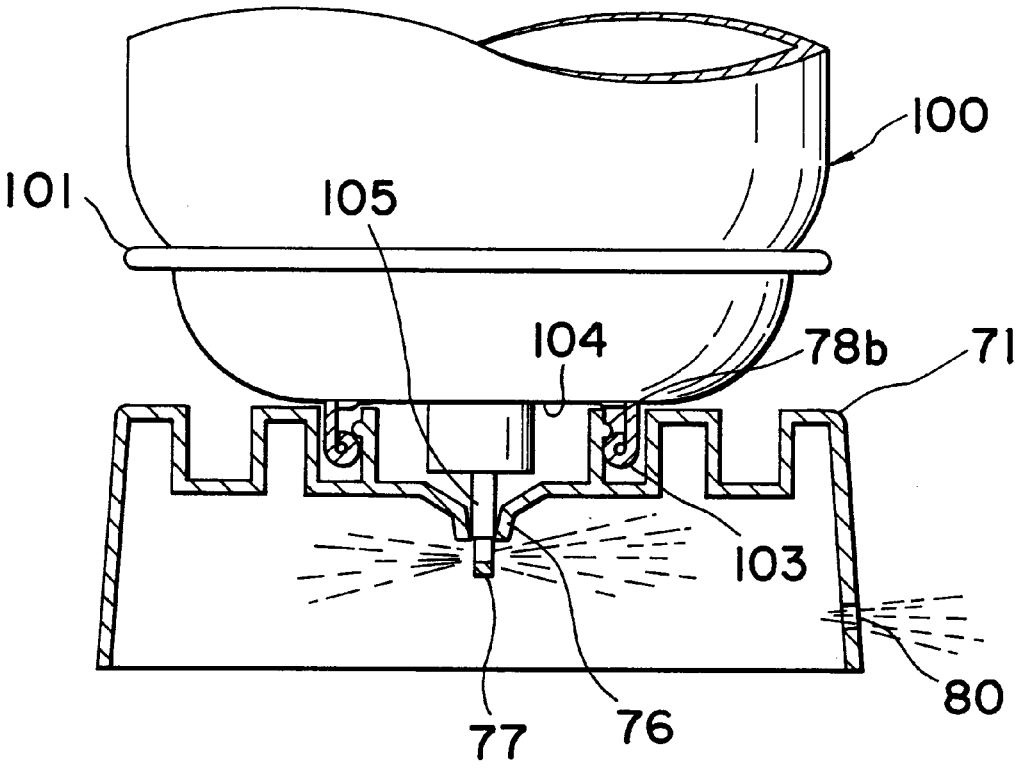
FIG. 29 is a longitudinal sectional view showing the using state of the degassing device shown in FIG. 26.

FIG. 26 is a perspective view of the degassing device 71, and FIG. 27 is a sectional view thereof. FIG. 28 shows the structure on the exhaust opening side of the engaging through-hole (an internal view), and FIG. 29 is a fragmentary sectional view showing the state in which the aerosol container 100 is mounted on the degassing device 71 for degassing.

The degassing device 71 is formed with an upper surface portion 72 integrally formed of plastic resin such as polypropylene, polystyrene, polycarbonate, etc. and having a suitable wall thickness and a peripheral side portion 73 formed to be vertical or somewhat spread open from the upper surface portion 72 and having a given height, being formed to be a laid recess configuration, the upper surface portion 72 being provided with a recess 74 capable of inserting a nozzle forming opening 104 of the aerosol container 100, a central portion of the bottom of the recess 74 is projected internally of the laid recess to constitute a depressed portion 75, the depressed portion 75 being interiorly provided with an engaging through-hole 76 formed to be convergent from the upper surface portion so that the end of the nozzle 105 of the aerosol container 100 can be inserted from the upper surface portion and stopped within the hole, a bridge-like direction changing portion 77 is provided externally of the end of an exhaust opening 76*a* of the engaging through-hole 76 so as to interrupt the axial direction of the hole, and both sides of the direction changing portion 77 remain opened. On the outside surrounding the engaging through-hole 76 within the bottom of the recess 74, notches 78*a* are formed at suitable parts (three substantially at equal intervals in the drawing) of an annular erected wall to impart a flexibility, an engaging projection 78*b* is provided on the outer surface of the annular erected wall to provide a connecting engaging portion 78 engageable with the inside of the caulked edge 103 in the peripheral edge of the nozzle forming opening 104, a portion between the connecting engaging portion 78 and the inner peripheral surface 74*a* of the recess 74 constitutes a groove 79 capable of inserting the caulked edge 103 of the aerosol container 100, and one or more (one in the drawing) discharge hole 80 is provided in the peripheral side 73.

The engaging through-hole 76 may employ other shapes and constructions in addition to the convergent shape as described above as long as it can insert the end of the nozzle 105 and stop it within the hole, for example, such that a difference-in-level portion is provided in the intermediate portion of the hole so as to place the end of the nozzle 105 in engagement with the difference-in-level portion, or a plurality of stop ribs extending in a direction coaxial with the hole are formed on the inner peripheral surface of the hole, said stop ribs constituting inclined projections projected toward the interior of the hole (toward the center axis) gradually in the direction of the end of the hole (in the direction of the inside of the lid) so that the end of the nozzle 105 engages the stop ribs. The stop rib is preferably formed with an inclined surface so that the stop rib can positively stop and press the nozzle even if the outside diameter of the nozzle 105 is somewhat different due to the difference of the container 100. If the degassing device 71 is formed of plastic material such as polypropylene, polystyrene, polycarbonate or the like, the generality of the above-described function is further enlarged in addition to the slight deformity of material itself.

The direction changing portion 77 may be formed similarly to the direction changing portion 10 in the above-described degassing device 1. For example, the portion opposite to the peripheral wall of the engaging through-hole 76 is extended by slight width, the direction changing portion 77 can be formed on the extended portion. The shape of the direction changing portion 77 may employ a suitable shape similarly to the direction changing portion 10 in the above-described degassing device 1.

Since in the connecting engaging portion 78, the notches 78*a* are formed at suitable locations of the annular erected wall to enable slight flexing deformation, even if the shape or the diameter of the caulked edge 103 is somewhat changed, the connecting engaging portion 78 can be elastically deformed accordingly so that the former may elastically engage the inside of the caulked edge 103. It is noted that the engaging projections 78*b* can be provided on the inner side of the annular erected wall to engage the outside of the caulked edge 103 of the aerosol container 100. Further, an engaging construction can be formed on the connecting engaging portion 78 so as to be engaged with parts to be engaged other than the caulked edge 103.

The discharge hole 80 is not limited to be provided in the peripheral side 73 but may be provided in the upper surface portion 72. Further, it is not provided as a hole but may be provided as a notch in the lower end edge of the peripheral side 73 so as to discharge the exhaust gas. Further, if an opening is provided in replace of the discharge hole, the exhaust hole 80 is not always required to be provided.

According to the degassing device 71 having the above-described structure, as shown in FIG. 29, the degassing device 71 is laid, for example, on the desk top, the nozzle 105 of the aerosol container 100 is inserted into the engaging through-hole 76, the caulked edge 103 is inserted into the groove 79, and the inside of the caulked edge 103 is elastically engaged with the engaging projection 78*b* of the connecting engaging portion 78. Then, the end of the nozzle 105 is fitted in the intermediate portion of the engaging through-hole 76 to place the nozzle 105 in the pressed state, that is, in the injection state. Therefore, if the aerosol container 100 is mounted on the degassing device 71, the aerosol container 100 can be maintained in the continuous injection state even if the hand is released so that degassing of the aerosol container 100 can be easily carried out.

Furthermore, since in the connecting engaging portion 78, the notches 78*a* are formed in the annular erected wall to impart the flexibility, the degassing device 1 can be mounted within the range of elastic deformation of the annular erected wall even if the aperture of the recess 74 of the degassing device 71 does not match the inside diameter of the caulked edge 103 of the aerosol container 100. Therefore, the degassing device can be suitably used for the aerosol containers of various makers different in dimensions and shapes.

Since the gases exhausted from the aerosol container 100 impinge upon the direction changing portion 77 and are not to be released in a straight line manner, it is possible to prevent the desk top surface on which the degassing device 71 is laid from being damaged or deformed. The gases in the degassing device 71 are discharged out of the discharge hole 80.

Note, the degassing device 71 is not placed in the state in which the former is laid on the desk top or the like, but the degassing device 71 in the upwardly open state can be mounted on the aerosol container 100 for degassing. In this case, since the exhausted gases are not released in a straight line manner by the direction changing portion 77, it is possible to prevent an danger in which for example, the exhausted gases are directly blown against the nearby persons or apparatuses.

Figure 30:
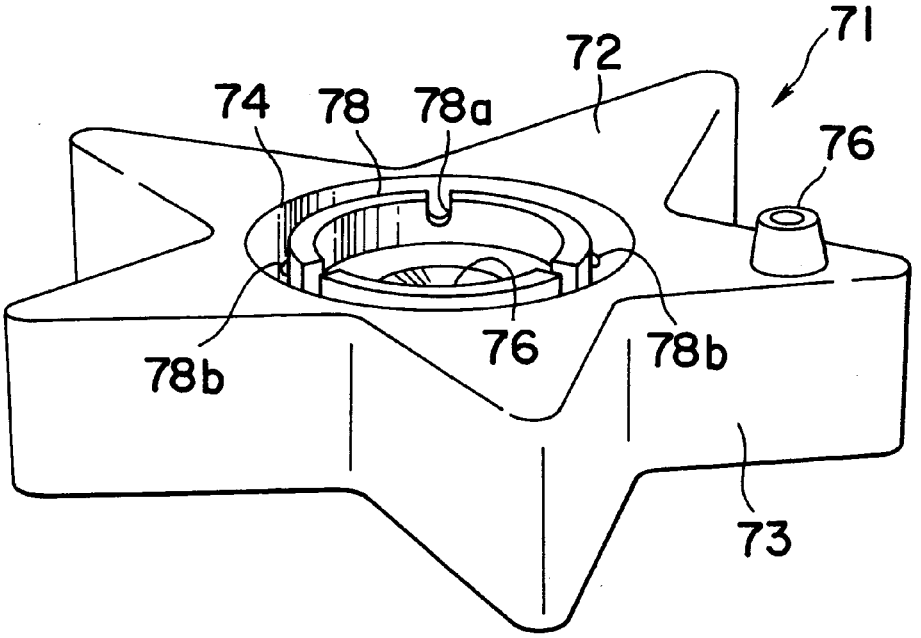
FIG. 30 is a perspective view showing a modified form of the degassing device shown in FIG. 26.

FIG. 30 is a view showing a modified form of the degassing device 71. As shown in this figure, the entire shape of the degassing device 71 may be a star shape, or other suitable shapes though not shown. Further, as shown in the figure, two or more engaging through-holes 76 and connecting engaging portions 78 can be provided.

Figure 31:
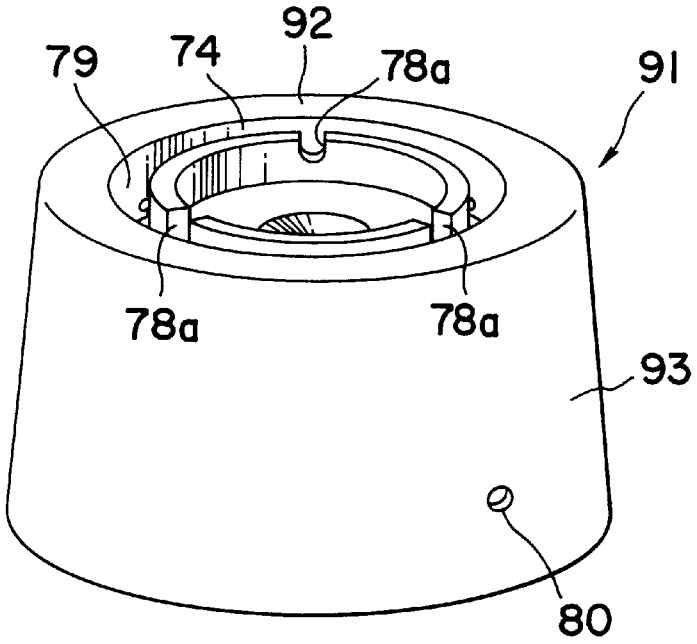
FIG. 31 is a perspective view showing one example of a lid according to an embodiment different from the lid shown in FIG. 9.
Figure 32:
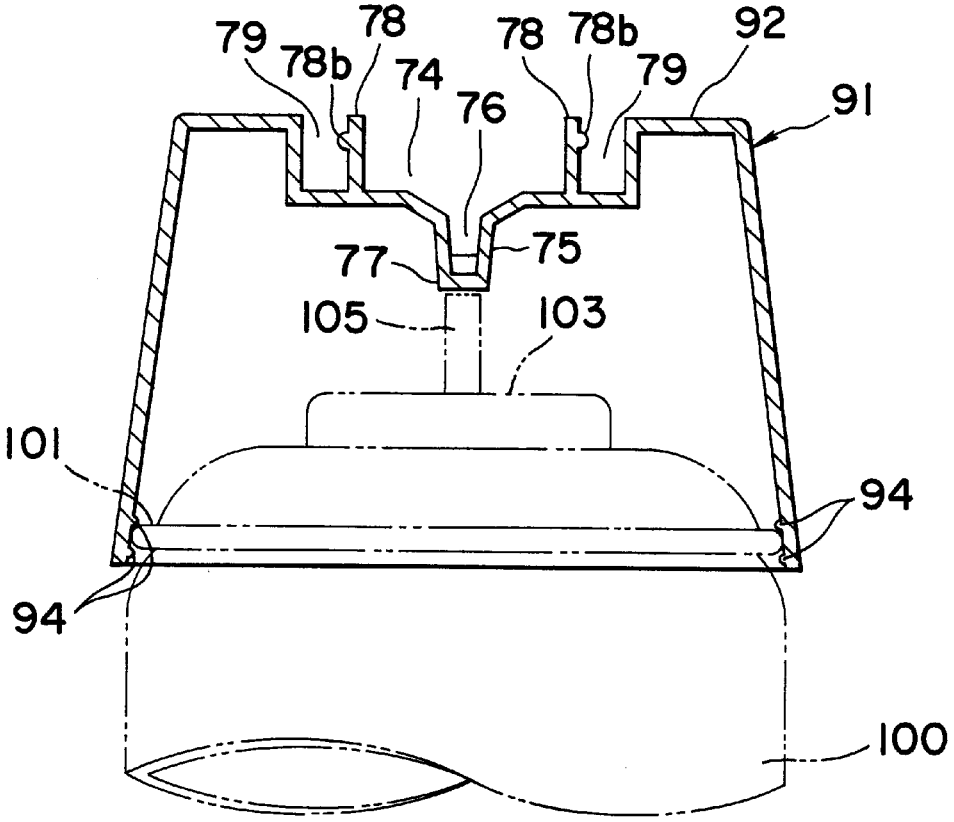
FIG. 32 is a longitudinal sectional view showing the state in which the lid shown in FIG. 31 is used as the lid for an aerosol container.

FIG. 31 is a perspective view showing a lid 91 provided on the upper surface portion of a degassing construction similar to the degassing device 71. FIG. 32 is a longitudinal sectional view showing the state in which the lid 91 is placed over the aerosol container 100 and used as a normal lid.

The lid 91 has a height enough not to press the nozzle 105 and has a tubular shape to be fitted over the upper end of the aerosol container 100. An upper surface portion 92 has the degassing construction similar to the above-described degassing device 71, that is, a recess 74, a depressed portion 75, an engaging through-hole 76, a direction changing portion 77, a connecting engaging portion 78 and a groove 79, a discharge hole 80 is provided in a peripheral side 93 thereof, and the peripheral side 93 is formed in an internal portion at the lower end thereof with a fitting portion 94 having a projection engageable with a caulked edge 101 in the form of a projecting edge formed in the upper peripheral edge of the body of the container.

Figure 33:
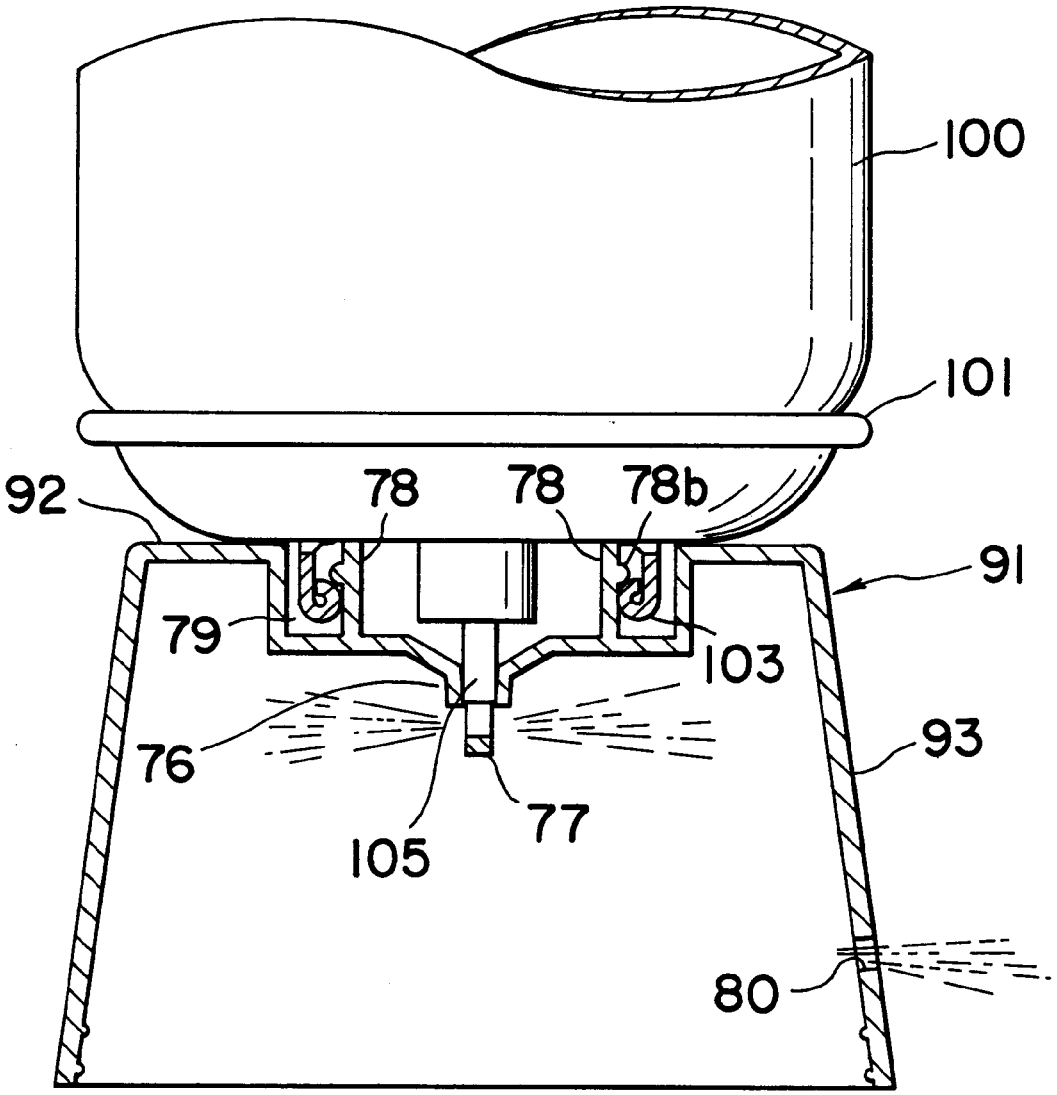
FIG. 33 is a longitudinal sectional view showing the degassing state in which the lid shown in FIG. 31 is reversely fitted on the container.

The lid 91 having the structure as described above is normally placed over the aerosol container 100 in the state in which a fitting portion 94 of the lid is fitted in the caulked edge 101 of the container for use, as shown in FIG. 32. However, when gases are removed from the aerosol container 100 as necessary, the lid 91 is once removed from the aerosol container, and the aerosol container 100 is mounted on the upper surface portion 9 similar to the above-described degassing device 71, as shown in FIG. 33. Then, the end of the nozzle 105 is stopped at the intermediate portion in the engaging through-hole 76 into the pressed state, and therefore, degassing of the aerosol container 100 can be carried out easily.

The shape of the lid 91 and the mounting construction with respect to the container 100 are not limited to the above. Further, the mounting parts in which the lid 91 is reversed and mounted on the upper portion of the container 100, the mounting construction and the like are neither limited to the above.

What is claimed is:

1. A degassing device for an aerosol container comprising:

an upper surface portion;

a peripheral side portion;

an annular wall portion provided in the upper surface portion for receiving a nozzle forming opening formed in an upper portion of the aerosol container, said annular wall portion being provided with an engaging portion in the peripheral edge thereof, and said engaging portion being engageable with an edge around an injection nozzle of the aerosol container;

an engaging through-hole provided in the central portion, surrounded by the annular wall portion in the upper surface portion and capable of engageably receiving an end of the injection nozzle of the aerosol container therein;

a direction changing portion formed integrally at an inner part of the engaging through-hole so as to cross an axis of the engaging through-hole and to form an opening on at least one side thereof; and wherein said engaging portion and said engaging through-hole being adapted to depress the injection nozzle and maintain the injection nozzle in a pressed state when the degassing device is disposed on the upper portion of the aerosol container.

2. The degassing device for an aerosol container according to claim 1, wherein said engaging through-hole has an inner diameter which is greater than an outer diameter of the nozzle and is formed with at least one stop rib in an inner peripheral surface of the hole which gradually increases in height so that as the nozzle is inserted it engages the tapered stop rib at a suitable position to press the nozzle and maintain it in the pressed state when the device is fitted onto the aerosol container.

3. The degassing device for an aerosol container according to claim 2, wherein the at least one stop rib is essentially tapered in shape.

4. A degassing device for an aerosol container comprising:

an upper surface portion;

a peripheral side portion;

a depressed portion provided in the upper surface portion for receiving a nozzle forming opening portion formed in an upper portion of the aerosol container, said depressed portion being provided with an engaging portion in a peripheral edge thereof which is arranged to engage a peripheral edge of a nozzle forming opening;

an engaging through-hole being provided in the central portion of the bottom of said depressed portion and capable of engageably receiving an extreme end of the injection nozzle of the aerosol container;

a direction changing portion formed at an inner part of the engaging through-hole so as to cross an axis of the engaging through-hole and form an opening on at least one side thereof; and wherein said engaging portion and said engaging through-hole are formed to keep the injection nozzle in a pressed state.

5. The degassing device for an aerosol container according to claim 4, wherein said engaging through-hole has the diameter selected to permit insertion of the nozzle thereinto and formed with at least one stop rib which projects out from an inner peripheral surface of the hole, the amount of stop rib projection gradually increasing from an end from which insertion is made toward the other end so that the inserted nozzle is engaged and stops at a predetermined position during the insertion and presses the nozzle in a manner which maintains it in the pressed state when the device is fitted onto the aerosol container.

6. A degassing device for an aerosol container comprising:

an upper surface portion;

a peripheral side portion;

an engaging through-hole provided in the upper surface portion into which an end of the injection nozzle of the aerosol container can be engageably inserted;

a direction changing portion formed integrally at an inner part of the engaging through-hole so as to interrupt an axial direction of the engaging through-hole and maintain an opening on a side thereof; and a connecting engaging portion formed with an annular erect portion externally surrounding said engaging through-hole within the upper surface portion, said annular erect portion being formed with an engaging projection engageable with a projecting edge formed around the injection nozzle of the aerosol container;

wherein said engaging portion and said engaging through-hole are formed to engage and maintain the injection nozzle in a pressed state.

7. The degassing device for an aerosol container according to claim 6, wherein said engaging through-hole has the diameter selected to permit the insertion of the nozzle thereinto and formed with a stop rib which projects out from an inner peripheral surface of the engaging through-hole, the amount of projection of the stop rib increasing from an end where insertion begins toward the other end, so that the inserted nozzle stops at a suitable position during insertion and the pressing state of the nozzle is maintained when the device is fitted onto the aerosol container.

8. A tubular lid provided with a degassing construction to be fitted in an aerosol container comprising:

a lid upper surface portion;

a peripheral side portion;

an annular wall portion provided in the lid upper surface portion for receiving a nozzle forming opening formed in the upper portion of the aerosol container, said annular wall portion being provided with an engaging portion in the peripheral edge thereof, said engaging portion being formed with an engaging portion engageable with a projecting edge formed around the injection nozzle of the aerosol container;

an engaging through-hole being provided in the central portion surrounded by the annular wall portion in the lid upper surface portion and adapted to engagingly receive an end of the injection nozzle of the aerosol container therein;

a direction changing portion formed integrally at an inner part of the engaging through-hole so as to extend across in front of engaging through-hole; and wherein said engaging portion and said engaging through-hole are formed to keep the injection nozzle in a pressed state when the tubular lid is disposed on the aerosol container in a predetermined manner.

9. The lid provided with a degassing construction according to claim 8, wherein said engaging through-hole has the diameter selected to permit the insertion of the nozzle therethrough and is formed with a stop rib in an inner peripheral surface thereof which engages the nozzle and prevents further insertion with the result that the nozzle depressed and maintained in a depressed state when the lid is disposed in a predetermined manner on the aerosol container.

10. The lid according to claim 9, wherein the stop rib is essentially tapered in shape.

11. A tubular lid provided with a degassing construction to be fitted in an aerosol container comprising:

a lid upper surface portion;

a peripheral side portion;

a depressed portion provided in the lid upper surface portion for receiving a nozzle forming opening formed in the upper portion of the aerosol container, said depressed portion being provided with an engaging portion in the peripheral edge portion thereof, said engaging portion being formed to engage the peripheral edge of the nozzle forming opening of the aerosol container;

an engaging through-hole being provided in the central portion of the bottom of said depressed portion into which an injection nozzle of the aerosol container is engageably inserted;

a direction changing portion which extends laterally across the axis of the engaging through-hole to deflect fluid flow from the injection nozzle; and wherein said engaging portion and said engaging through-hole being formed to be able to keep the injection nozzle in a pressed state.

12. The lid provided with a degassing construction according to claim 11, wherein said engaging through-hole has the diameter selected to permit the insertion of the nozzle therethrough and is formed with a tapered stop rib in an inner peripheral surface thereof which engages the nozzle and prevents further insertion with the result that the nozzle depressed and maintained in a depressed state when the lid is disposed in a predetermined manner on the aerosol container.

13. The lid according to claim 12, wherein the stop rib is essentially tapered in shape.

14. A tubular lid provided with a degassing construction to be fitted in an aerosol container comprising:

a lid upper surface portion;

a peripheral side portion;

an engaging through-hole provided in the lid upper surface portion and adapted to receive an end of the injection nozzle of the aerosol container and retaining it therein;

a direction changing portion formed at one end of the engaging through-hole so as to interrupt an axial direction of the engaging through-hole and maintain an opening on the side; and a connecting engaging portion formed with an annular erect portion externally surrounding said engaging through-hole within the lid upper surface portion, said annular erect portion being formed with an engaging projection engageable with a projecting edge formed around the injection nozzle of the aerosol container;

wherein said engaging portion and said engaging through-hole being formed to be able to keep the injection nozzle in a pressed state.

15. The lid provided with a degassing construction according to claim 14, wherein said engaging through-hole has the diameter selected to permit the insertion of the nozzle therethrough and is formed with a tapered stop rib in an inner peripheral surface thereof which engages the nozzle and prevents further insertion with the result that the nozzle depressed and maintained in a depressed state when the lid is disposed in a predetermined manner on the aerosol container.

16. The lid according to claim 15, wherein the stop rib is essentially tapered in shape.

* * * * *